United States Patent [19]

McDonald

[11] 3,941,134

[45] Mar. 2, 1976

[54] APPARATUS FOR PIERCING EARLOBES

[75] Inventor: Maxwell Wilson McDonald, Mill Valley, Calif.

[73] Assignee: Golden M Enterprises, Inc., Mill Valley, Calif.

[22] Filed: Jan. 17, 1974

[21] Appl. No.: 435,394

[52] U.S. Cl. ..... 128/330
[51] Int. Cl.[2] ..... A61B 17/00
[58] Field of Search ..... 128/329, 330

[56] References Cited

UNITED STATES PATENTS

| | | | |
|---|---|---|---|
| 2,798,491 | 7/1957 | Samuels | 128/330 |
| 3,039,467 | 6/1962 | Stone et al. | 128/329 |
| 3,187,751 | 6/1965 | Coren et al. | 128/330 |
| 3,641,804 | 2/1972 | Oudenhoven | 128/330 X |
| 3,831,597 | 8/1974 | Shiller | 128/330 |

FOREIGN PATENTS OR APPLICATIONS

| | | | |
|---|---|---|---|
| 2,597 | 1903 | United Kingdom | 128/330 |
| 527,365 | 7/1956 | Canada | 128/329 |

*Primary Examiner*—Channing L. Pace
*Attorney, Agent, or Firm*—Townsend and Townsend

[57] ABSTRACT

An earlobe piercer which has a pair of jaws that are movable towards and away from each other and a pressure plate mounted to one of the jaws which engages and holds the earlobe to be pierced. A slot in the pressure plate has a bottom end that supports one end of a piercing stud. The other end of the stud is disposed in an actuating mechanism which can be released to drive the stud linearly forward and through the earlobe while the stud is guided by the slot bottom. An enlarged cutout in the pressure plate provides visual access to the earlobe to be pierced to facilitate the alignment of any given point on the lobe with the stud. The piercer further provides means for positioning a stud-engaging clip which has an aperture that intercepts the travel path of the stud so that the stud engages the clip at the end of the piercing operation to thereby secure it to the earlobe.

10 Claims, 7 Drawing Figures

APPARATUS FOR PIERCING EARLOBES

BACKGROUND OF THE INVENTION

U.S. Pat. No. 3,187,751, the disclosure of which is incorporated herein by reference, discloses an advantageous device for piercing earlobes. Briefly, the ear piercer disclosed in that patent comprises a handheld instrument having opposed jaws which are movable towards and away from each other and between which the earlobe to be pierced is clamped. One of the jaws is provided with means for receiving a pointed stud and driving it through the lobe while the latter is clamped between the jaws. The other of the two jaws has means for receiving the end of the stud which passes through the lobe. The device is constructed so that the instrument is readily removed from its piercing position the earlobe while leaving the stud inserted therethrough by simply moving the device in a direction perpendicular to the stud axis away from the lobe.

In the lobe piercer of the above-referenced patent the stud is provided with a cylindrical head of close tolerance that can be extended into a bore in a spring actuated plunger which in turn forces the stud through the earlobe. For accurate, straight and painless earlobe piercing the stud must travel in a straight, axial direction. In the referred to prior art device this is accomplished by dimensioning the stud head so that it snugly engages the bore in the plunger and is frictionally secured thereto while the remainder of the stud protrudes forwardly. Since this remainder is unsupported the head has a sufficient length so that the stud is positioned, held, guided and driven by the plunger and the bore therein. This snug fit is necessary to prevent the stud from wobbling while it is driven forward by the plunger Even though the referenced patent contemplates that the device is simply withdrawn from the earlobe after the piercing operation, the frictional engagement between the head and the plunger bore can cause problems since a relatively tight frictional fit is required to maintain the stud in position and alignment with the plunger. Such tight engagement, however, is not conductive to the ready removal of the piercer. In fact, proper removal may require the application of axially oriented, opposing forces to the plunger, or the piercing device per se, and the stud which is to remain in the earlobe. Failure to do so may cause the retention of the stud in the plunger bore and a resulting withdrawal of the stud from the earlobe. Since such a withdrawal is never in an axial direction, but perpendicular thereto, this may be painful and in severe circumstances may cause injury. On the other hand, loosening the fit between the stud head and the plunger bore may prevent an axial alignment of the stud with the plunger during the piercing operation and may prevent the piercing of the lobe and/or maim the lobe because the relative movement of the plunger may be in a direction offset from its axis.

The just-referred to necessary interrelationship between the stud head and the plunger bore places a further undesirable limitation on the studs. The head must be cylindrical or the necessary holding, positioning and guiding function is lost. It is not possible, for example, to employ spherically-shaped stud heads even though they may be aesthetically more attractive.

The referenced patent also contemplates the use of clips for securing the stud to the earlobe during the healing process which usually takes several weeks. Such clips are well known and generally comprise a disc provided with a stud engaging aperture that is constructed so as to snap onto the stud. To prevent accidental loss of the clip the studs are usually provided with a clip engaging groove adjacent their pointed end. In accordance with the prior art, and particularly as disclosed in the above-referenced patent, the clips are manually slipped onto the stud end protruding from the just-pierced earlobe. This is not only time consuming but also painful since it requires a manipulation of the lobe.

Lastly, it is difficult to align the earlobe piercer of the above-referenced patent with a particular point on the lobe to be pierced. Frequently, the location at which the lobe is to be pierced is marked by applying a small dot thereto. Thereafter the piercer is placed over the lobe and the stud is inserted. However, for proper alignment the stud must be aligned with the mark. A pressure plate employed by the piercer of the above patent includes a long, narrow slit through which the stud is subsequently moved. However, during the alignment process the stud is retracted from the pressure plate so that it is difficult to judge at which precise point the stud will enter the earlobe. Furthermore, the slit is so narrow as to make it difficult to find the mark on the earlobe after the earlobe is placed between the jaws of the piercer.

Thus, even though the piercer of the referenced patent is a substantial advance over theretofore available devices and earlobe piercing methods, it still has numerous disadvantages which limits its usefulness and, therefore, its commercial acceptance.

SUMMARY OF THE INVENTION

The present invention is primarily an improvement to the piercer of the above-referenced patent. It eliminates the need for tight frictional engagements between the driving plunger and the stud head so that the piercer is readily removed by simply opening the jaws whereupon the stud head becomes disengaged from the corresponding bore in the plunger. To this end, the device of the present invention employs a pressure plate which has a slot aligned with the axis of the plunger and of the stud and which terminates so that the stud can rest on the slot end while its other end, i.e. the stud head is disposed in the plunger bore and the stud is coaxially aligned with the plunger. The pointed end of the stud is furthermore in close proximity to the earlobe since it always rests on the bottom wall of the slot in the pressure plate. Alignment of the plunger with a piercing mark on the earlobe is thereby facilitated. The ease of aligning the stud with the mark is further enhanced by providing the pressure plate with an enlarged cutout just above the lower end of the slot so that a substantial portion of the earlobe is visible and the relatively small piercing mark is readily found for positioning and alignment of the device.

The present invention further provides means for combining the stud insertion with securing it to retaining clip after the stud has pierced the earlobe. This eliminates the need for time-consuming and frequently painful manipulation of the earlobe to attach a clip to the stud.

Means is provided to position and hold the clip so that its stud-engaging aperture is aligned with or intercepts the travel path of the stud. In the preferred embodiment of the invention such means comprise a generally horizontal clip-loading surface and two vertical, spaced-apart posts which engage lateral loops of the clip and which are defined by or mounted to the jaw opposing the jaw that mounts the spring-actuated plunger.

Generally speaking, an earlobe piercer constructed in accordance with invention comprises first and second jaws, means for moving the jaws towards and away from each other, and a pressure plate mounted to the first jaw. The pressure plate has an elongate slot that terminates in a bottom wall. Means is provided for spacing a side of the pressure plate facing the second jaw from the second jaw when the jaws are in their proximate position. A piercing stud has a first, pointed end, a cylindrical portion adjacent the end, and a second end defined by a head of a given cross section which fits into a recessed opening of an elongate plunger facing towards the second jaw. The opening in the plunger has a cross section slightly greater than the cross section of the head so that the head can be received in the opening without significant frictional engagement therewith. Plunger positioning and actuating means on the first jaw includes means guiding the plunger in an axial direction for travel towards and away from the second jaw along an axis spaced from the bottom wall by about one half the stud diameter and means for subjecting the plunger to a force moving it rapidly towards the second jaw. The plunger has a length so that when it is in its position remote from the second jaw and the stud head is disposed in the plunger opening the cylindrical portion of the stud is supported by the slot bottom wall so that release of the plunger forcing means causes movement of the stud towards the second jaw while its direction of movement is guided and determined by both the bottom wall of the slot and the opening in the plunger for movement of the plunger in an axial direction towards, into and through the earlobe disposed between the pressure plate and the second jaw.

DESCRIPTION OF THE PREFERRED EMBODIMENTS

Figure 1:
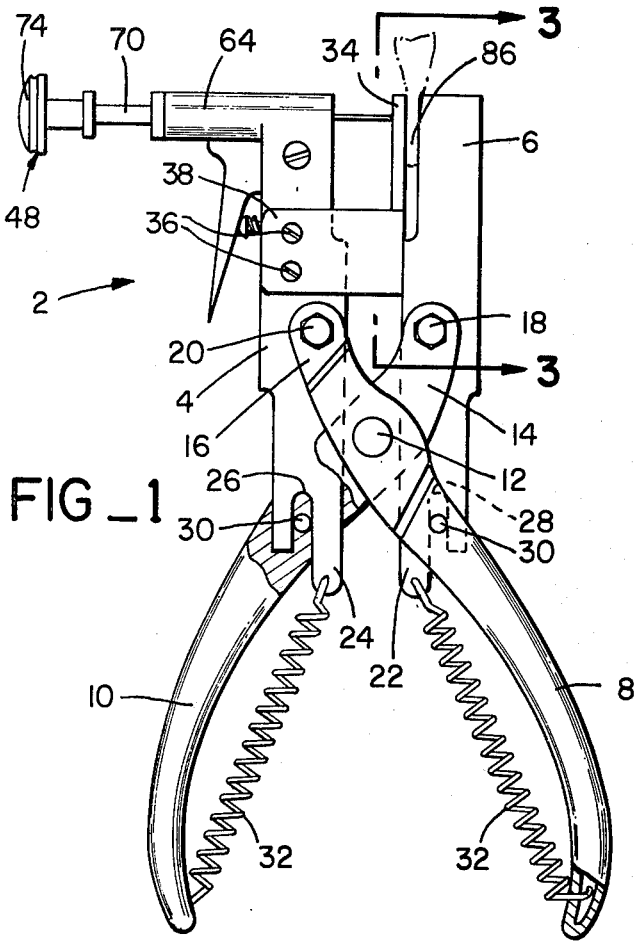
FIG. 1 is a side elevational view of an earlobe piercing device constructed in accordance with the present invention.

Referring to FIG. 1, an earlobe piercing device 2 constructed in accordance with the invention has two opposing jaws 4 and 6 which are mounted for parallel movement towards and away from each other. Movement is imparted with a pair of handles 8, 10 which are shaped to fit in the palm of a hand. A pivot pin 12 connects the handles.

Jaws 4 and 6 are pivotally connected to upper portions 14, 16 of the handles with bolts 18 and 20. Lower portions 22, 24 of the jaws include upwardly extending slots 26, 28 engaged by pins 30 to permit vertical movement of the jaws relative to the pins. Coiled springs 32 are connected between lower portions 22, 24 of jaws 4 and 6 and the lower ends of the respective handles 8, 10.

The springs normally bias the jaws into the open position. Upon compression of handles 8, 10 the jaws are brought together into the position shown in FIG. 1. The relative movement of the jaws is parallel because of the restraining action of pins 30 which can travel only along slots 26 and 28.

Figure 3:
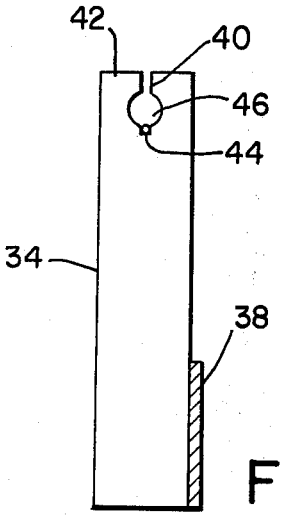
FIG. 3 is a side elevational view, in section, and is taken on line 3—3 of FIG. 1.
Figure 2:
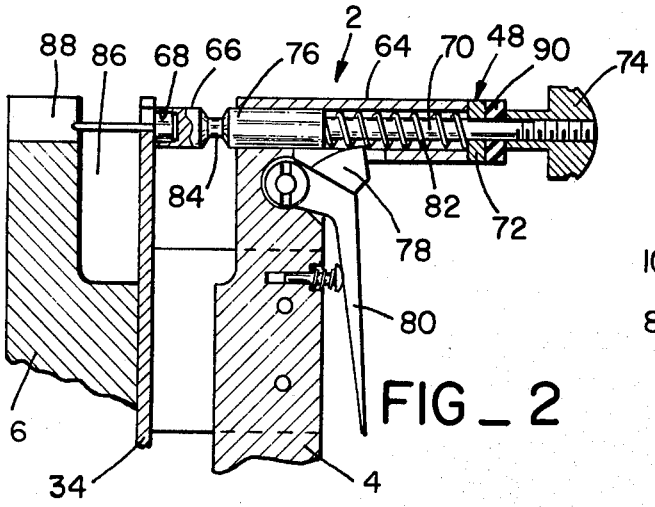
FIG. 2 is a fragmentary, enlarged side elevational view, in section, through the portion of the piercing device shown in FIG. 1 which effects the piercing of the earlobe.

Referring to FIGS. 1–3, a pressure plate 34 is disposed between jaws 4 and 6 and includes an angle bracket 38 which is secured to a side of a jaw 4 with a pair of bolts 36. A narrow slot 40 extends downwardly from an upper end 42 of the pressure plate and terminates in a flat bottom wall 44. An enlarged section or cutout 46 communicates with slot 40 and is spaced slightly above bottom wall 44.

Figure 5:
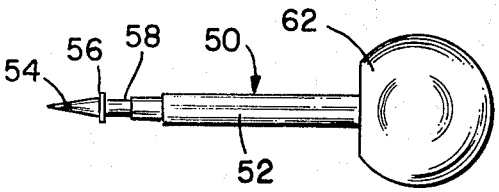
FIG. 5 is a view similar to FIG. 1 but shows a stud having a spherically shaped head.
Figure 4:
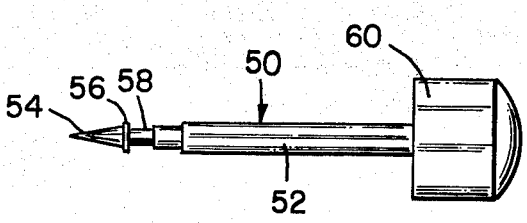
FIG. 4 is an enlarged, fragmentary view of a earlobe piercing stud having a cylindrical head constructed in accordance with the invention.

Pressure plate slot 40 is laterally aligned with an axis through an actuating device 48 for propelling an earlobe piercing stud 50 through the earlobe of a patient. Referring momentarily to FIGS. 4 and 5, stud 50 has an elongate shaft 52 that terminates in a pointed end 54. A narrow, cylindrical flange 56 has the same diameter as shaft 52 and separates the pointed end from a recessed shaft portion 58. The other end of the stud is provided with a cylindrical or spherically shaped head 60, 62, respectively.

Referring again to FIGS. 1–3, actuator 48 generally comprises a tubular barrel 64 that is horizontally disposed on top of jaw 4. A plunger 66 is slideably disposed within the barrel and includes a cylindrical bore or recess 68 which has a diameter slightly greater than the diameter of the stud heads 60 or 62 to prevent frictional engagement between the two when a stud head is inserted in the bore so that the head is loosely disposed therein. The other end of the plunger includes a reduced diameter shank 70 which extends through a plate 72 that closes barrel 64. The free end of the shank is threaded and mounts an actuating knob 74. The plunger includes a flange 76 engageable by a latch member 78 of a trigger 80 that is pivotally mounted to the side of jaw 4 facing away from the jaw 6. A compression spring 82 biases plunger 66 to the left, as viewed in FIG. 2, towards jaw 6. The plunger can be retracted, or moved to the right as viewed in FIG. 2, by grasping knob 74 and pulling the plunger against the spring force until latch 78 rests in a groove 84 between flange 76 and the cylindrical forward end of the plunger. Compression of trigger 80 disengages the latch from the groove and enables spring 82 to move the plunger towards jaw 6.

The bottom wall 44 of slot 40 in pressure plate 34 is positioned so that it is below the axis of plunger 66 by a distance equal to one half the stud diameter. The plunger has a length so that when it is in its retracted position, that is when spring 82 is compressed, cylindrical flange 56 adjacent the pointed stud end 54 rests on bottom wall 44 of slot 40. In this position, the stud is in precise alignment with the axis of the plunger. Upon release of trigger 80 the spring rapidly moves plunger 66 and stud 50 forward, that is to the left as viewed in FIG. 2, until the free plunger end is immediately adjacent but still spaced from the side of pressure plate 34 facing jaw 6. At that point the shaft 52 of the stud extends fully across a space 86 between the pressure plate and jaw 4. The upper end of jaw 6 includes a groove 88 into which the stud tip can enter. Slot 40 in the pressure plate has a width less than the stud head diameter so that the stud cannot travel past the pressure plate. To prevent shock and discomforting vibrations the plunger is constructed so that its free end is spaced a slight distance from the side of pressure plate 34 facing jaw 4 when knob 74 engages a resilient rubber washer 90.

Turning now to the operation of the present invention, plunger 66 is first retracted until it is engaged by latch 78 and a stud is placed in the device so that its head is disposed in plunger bore 68 while its forward end is supported by bottom wall 44 of pressure plate slot 40. Next the device is grasped with a single hand and the earlobe is inserted in space 86 between pressure plate 34 and jaw 6. Upon compression of handles 8 and 10 the jaws are moved towards each other until they are in the position in which they engage the earlobe shown in dotted lines in FIG. 1. At that point the jaws slightly compress the earlobe.

Before actual compression the tip of the stud is aligned with the pierce mark on the lobe (not shown in the drawings) or, absent such a mark, with the position at which the lobe is to be pierced. Thereafter, trigger 80 is compressed to release the plunger so that spring 82 drives the stud through the earlobe. The plunger is now retracted with the operator's second hand, the handles 8 and 10 are released to move the jaws apart, and the device is withdrawn in a downward direction away from the earlobe. During this movement the stud is completely disengaged from the remainder of the device. It will be noted that during the centering operation of the device prior to the actual piercing cutout 46 in the pressure plate provides ample view of the area to be pierced. Thus, the operator quickly spots any pierce mark thereon and since the stud tip 54 is in slot 40 it is readily aligned therewith.

As already briefly referred to earlier, the present invention enables the use of studs having either cylindrical or round or generally spherical heads since there is no need for a tight frictional engagement between the heads and the bore in the plunger to guide the stud forward without wobbles since the stud is supported at two points, the slot and the plunger bore.

Figure 6:
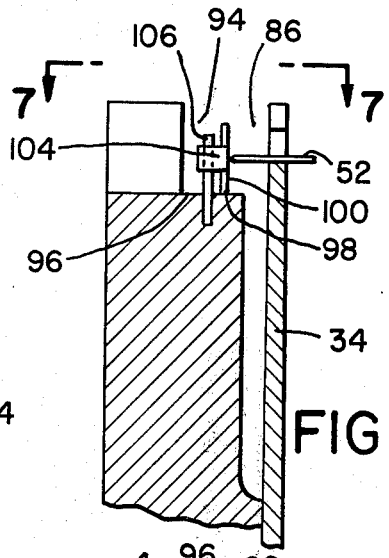
FIG. 6 is an enlarged, fragmentary side elevational view, in section, similar to FIG. 2 and shows the manner in which a stud retaining clip is held and positioned for automatically engaging the stud piercing the lobe.
Figure 7:
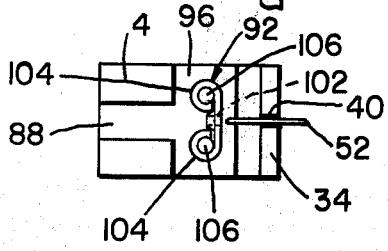
FIG. 7 is a plan view and is taken on line 7—7 of FIG. 6.

Referring briefly to FIGS. 6 and 7, the present invention also provides means for securing a stud retaining clip 92 to the stud after it has pierced through the earlobe. For that purpose the upper end of jaw 4 includes a recess 94 that defines a flat horizontal surface 96. That surface is spaced a distance from the axis of plunger 66 and stud shaft 52 equal to the distance between a lower edge 98 of a disc portion 100 of the grip and a shaft engaging aperture 102 of the clip. Consequently, the clip aperture is in vertical alignment with the stud. The clip further includes a pair of laterally spaced, vertically oriented loops 104. A pair of upright posts 106 extend from surface 96 and they are spaced a distance equal to the center spacing of loops 104 so that the clip can be passed over the vertical posts until its lower edge 98 rests on horizontal jaw surface 96. At that point the clip aperture is aligned with the plunger axis and intercepts the stud tip as it advances past the earlobe until the aperture engages the recessed shaft portion 58 (see FIGS. 4 and 5) to thereby secure the clip to the stud. To facilitate the subsequent removal of the device from the earlobe and from engagement with the stud and the clip posts 106 have a diameter slightly less than the inside diameter of clip loops 104 so that the clip slides readily upwardly with respect to the posts when the piercing device is withdrawn in a downward direction away from the ear.

It will be apparent that the construction of the clip holder can be modified from that shown in FIGS. 6 and 7 and described in the preceding paragraphs. For example, instead of forming recess 94 and providing posts 106 a suitably shaped leaf spring (not shown) can be provided to clamp and position the clip between the spring and the side of the jaw facing pressure plate 34. Or a suitable cavity such as a bore (not shown) can be formed in the jaw which properly receives and positions the clip. Further modifications will readily come to mind to those skilled in the art.

I claim:

1. In an earlobe piercing device having first and second jaws mounted for parallel relative movement towards and away from each other, a pressure plate attached to the first jaw in parallel and spaced-apart relation thereto for movement of the plate with the first jaw towards and away from the second jaw, a piston slideably mounted on the first jaw including a recessed bore for receiving a head of a piercing stud, and means for forcing the piston in an axial direction towards the second jaw so that an earlobe placed between the second jaw and the pressure plate can be pierced with a free end of a stud inserted in the recessed bore of the piston, the stud having a given diameter, the improvement comprising an elongate slot in the pressure plate terminating in a bottom wall, the slot being laterally aligned with the axis of the piston, the bottom wall being parallel to the axis and spaced therefrom substantially one-half the stud diameter for supporting the stud while a head thereof is disposed within the recessed bore and for guiding the stud in a straight line when it is forced towards the second jaw.

2. Apparatus according to claim 1 includng a cutout in the pressure plate having a width substantially greater than the width of the slot, communicating with the slot, and spaced from the bottom wall to enable the visual alignment of the stud with a desired point on the earlobe to be pierced.

3. Apparatus according to claim 1 wherein the recessed bore has a diameter slightly greater than the maximum cross section of the stud head to prevent frictional engagements between the stud and the bore.

4. Apparatus according to claim 1 wherein the free stud end is to be engaged with a clip having an aperture through which the stud can be extended and means for engaging the clip, and including a pair of spaced apart parallel posts secured to the second jaw and positioned for engaging the engaging means of the clip for mounting and positioning the clip on the second jaw, and means positioning the clip while engaged by the posts so that the aperture is aligned with the piston axis, whereby the stud engages the clip after it has been forced towards the second jaw by the piston and has pierced the earlobe.

5. Apparatus for piercing earlobes comprising first and second jaws, means for moving the jaws towards and away from each other, actuating means mounted to the first jaw and including an axially movable piston and a spring actuator for driving the piston towards the second jaw, a free end of the piston facing the second jaw including a cylindrical recess, a pressure plate disposed between the jaws, secured to the first jaw and positioned to intercept movement of the piston toward the second jaw and to thereby prevent contact between the piston and the earlobe to be pierced, the first jaw having a portion in alignment with the piston axis which is spaced from the second jaw when the jaws are moved into their proximate positions, the pressure plate including a slot aligned with the axis and terminating in an end positoned so that a stud to be driven through the earlobe and having an end supported in the recess has another free end supported by the slot end while the stud is maintined in alignment with the axis so that the slot end guides the stud when the spring actuator is released to drive the dree end of the piston towards the second jaw.

6. Apparatus for piercing earlobes comprising first and second parallel jaws, means for moving the jaws towards and away from each other, a pressure plate mounted to the first jaw and having an elongate slot terminating in a bottom wall, means for spacing a side of the plate facing the second jaw from the second jaw when the jaws are in their proximate position, a piercing stud having a first, pointed end, a cylindrical portion adjacent the end, and a second end defined by a head of a given cross section, an elongate plunger having a recessed opening in one of its ends facing towards the second jaw, the opening having a cross section slightly greater than the cross section of the head so that the head can be received in the opening without significant frictional engagement therewith, plunger positioning and actuating means on the first jaw including means guiding the plunger in an axial direction for travel towards and away from the second jaw along an axis spaced from the bottom wall by about one half the stud diameter, and means for subjecting the plunger to a force moving it rapidly towards the second jaw, the plunger having a length so that when it is in its position remote from the second jaw and the stud head is disposed in the plunger opening the cylindrical portion of the stud is supported by the slot bottom wall so that release of the plunger forcing means causes movement of the stud towards the second jaw while its direction of movement is guided and determined by both the bottom wall of the slot and the opening in the plunger for movement of the stud in an axial direction towards, into and through an earlobe when disposed between the pressure plate and the second jaw.

7. Apparatus according to claim 6 wherein the second jaw includes a cutout for receiving the portion of the stud which is adapted to protrude past an earlobe.

8. Apparatus according to claim 7 wherein the slot has a width less than a cross-sectional dimension of the stud head.

9. Apparatus for piercing earlobes comprising first and second jaws movable towards and away from each other, actuating means for holding and moving an earlobe-piercing stud in a straight line from adjacent the first jaw towards the second jaw, a pressure plate secured to the first jaw having a surface slidably engaged by the stud as it travels towards the second jaw for supporting and guiding the stud during such travel, means for securing the pressure plate to the first jaw, means defining a space for a portion of an earlobe to be pierced between the pressure plate and the second jaw when the jaws are in their proximate positions, and means on the second jaw for holding a stud engaging clip having a stud engaging aperture and lateral loops so that the aperture intercepts the travel path of the stud when it moves towards the second jaw, the last mentioned means comprising a pair of spaced apart posts protruding from a positioning surface attached to the second jaw and extending through the loops.

10. Apparatus for piercing earlobes by driving an elongate stud therethrough comprising first and second jaws, means for moving the jaws toward and away from each other, actuating means mounted to the first jaw and including an axially movable piston, means for engaging the stud, and means for axially driving the piston and a stud engaged by the piston towards the second jaw, a pressure plate disposed between the jaws and secured to the first jaw, the pressure plate including a slot aligned with the piston axis and terminating in a bottom wall spaced from the piston axis so that a stud engaged by the piston can axially pass through the slot, the plate further including a cutout having a width substantially greater than the width of the slot, communicating with the slot, and spaced from the bottom wall to enable the visual alignment of the stud with a desired point on the earlobe to be pierced.

* * * * *